US006237466B1

(12) United States Patent
Fukuhara et al.

(10) Patent No.: US 6,237,466 B1
(45) Date of Patent: May 29, 2001

(54) VANE TYPE HYDRAULIC ACTUATOR

(75) Inventors: Katsuyuki Fukuhara, Hyogo; Mutsuo Sekiya, Tokyo, both of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/293,987

(22) Filed: Apr. 19, 1999

(30) Foreign Application Priority Data

Dec. 7, 1998 (JP) ..... 10-347515

(51) Int. Cl.[7] ..... F01C 9/00
(52) U.S. Cl. ..... 92/125
(58) Field of Search ..... 91/44, 45; 92/125, 92/182, 185; 418/148

(56) References Cited

U.S. PATENT DOCUMENTS 2,790,520 * 4/1957 Kuhn ..... 92/125
5,332,236 * 7/1994 Kastuhara et al. ..... 277/165
5,816,204 * 10/1998 Moriya et al. ..... 123/90.17

FOREIGN PATENT DOCUMENTS 9-60507 3/1997 (JP) .

* cited by examiner

*Primary Examiner*—Christopher Verdier
*Assistant Examiner*—Thomas E. Lazo
(74) *Attorney, Agent, or Firm*—Sughrue, Mion, Zinn, Macpeak & Seas, PLLC

(57) ABSTRACT

A vane type hydraulic actuator, wherein a chip seal 1, as a seal element between the case 43 and the rotor 44, can be pressed to contact tightly with the counter surface, without using a spring 47 as in the prior art, when a working oil is supplied either from the oil pressure chambers for timing retard or for timing advance. Simultaneously, the locking between the rotor 44 and the case 43 can be released. The hydrodynamic resistance at the gap between the tip of the seal element (chip seal) 1 and the counter surface of the seal element is made larger than that at the gap between the flank of the seal element 1 and the flank of the seal groove 2, which accomodates the seal element, so that the working oil of the hydraulic actuator flows between the flanks. The working oil at the bottom of the seal element urges the seal element to contact tightly with the counter surface. An oil channel 6 connects the bottom of the seal groove and a stopper pin holding hole 4, which holds a stopper pin 3 pressed by a spring 5. When a working oil is supplied from either of oil pressure chambers for timing retard or advance, the channel 6 opens to supply a working oil into the stopper pin holding hole 5 so as to displace the pin against the biasing force of the spring 5 to release the suppression of rotation.

14 Claims, 17 Drawing Sheets

FIG.3(a)
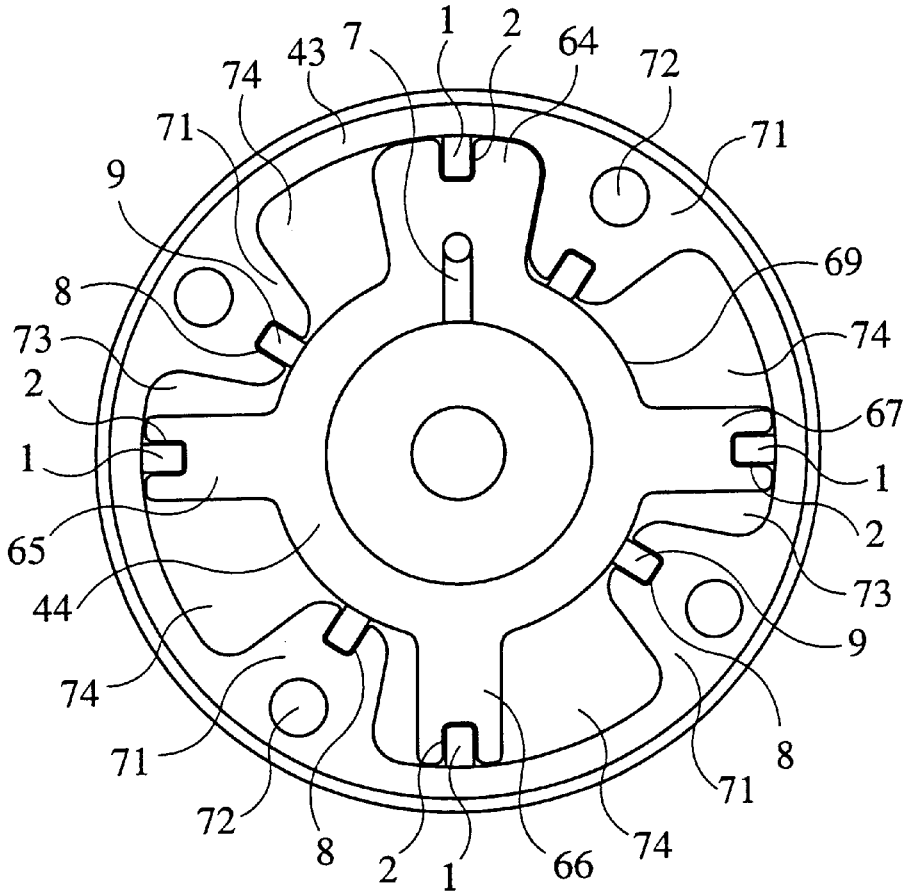
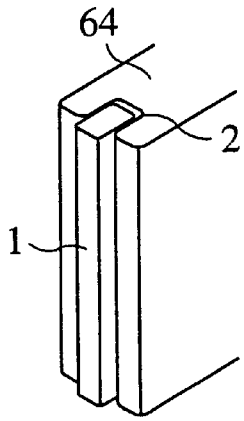
FIG.3(b)
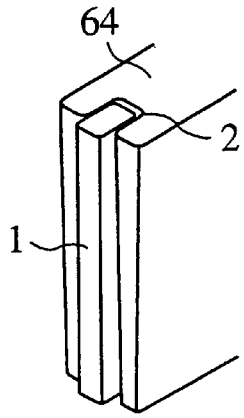
FIG.3(c)

VANE TYPE HYDRAULIC ACTUATOR

BACKGROUND OF THE INVENTION

1. Field of the Invention

The present invention relates to a vane type hydraulic actuator for use, for example, in a valve timing adjusting apparatus, which controls the timing of opening and closing of an intake valve and/or exhaust valve of an engine, in response to the running condition of the engine.

2. Description of the Prior Art

FIG. 23 is a cross sectional view of a vane type hydraulic actuator of the prior art, specifically, it is a vane type hydraulic actuator shown in Japanese Patent Application JP-A-314069 applied by the same applicant of this patent application. FIG. 24 is a detailed cross sectional view of the plunger portion of the actuator shown in FIG. 23, which is a main portion of the actuator. FIG. 25 is a cross sectional view of the plunger portion shown in FIG. 24, at a state when an oil pressure is applied.

Reference numeral 19 denotes a cam shaft for an intake valve having a cam for the intake valve 19*a*. A timing pulley 21 is disposed at an end portion of the cam shaft 19. An actuator for valve timing adjusting is connected with the cam shaft 19. The working oil of the actuator 40 is the lubrication oil of the engine (not shown). The actuator 40 functions to change the biasing angle of the cam shaft 19 so as to change continuously the timing of the opening and closing of the intake valve (not shown). Reference numeral 41 is a bearing for the cam shaft 19, and reference numeral 42 denotes the housing of the actuator 40, which can rotate relatively to the cam shaft for the intake valve 19.

A case 43 is fixed to the housing 42, which accommodates a vane type rotor 44 therein. The rotor 44 is fixed to the cam shaft 19 by a bolt 45, and can rotate relatively to the case 43.

A chip seal 46 is disposed between the case 43 and the rotor 44, for preventing the leakage of working oil between chambers limited by the case 43 and the rotor 44. For this purpose, the chip seal 46 is urged by a plate spring 47 to contact tightly with the rotor 44.

A cover 28 is fixed to the case 43. The housing 42, the case 43 and the cover 48 are commonly fastened by a bolt 49. Reference numerals 50, 51, and 52 denote an O-ring, a plate, and a bolt, respectively. Reference numerals 53, 54 denote O-rings. A cylindrical holder 55 is disposed in the rotor 44. The holder has an engaging hole 55*a* extending in the longitudinal direction of a plunger 56 so as to engage with the plunger 56.

The plunger 56 can slide in the housing 42, and has an engaging shaft portion 56*a*, which can enter into the engaging hole 55*a* of the holder 55 and can engage with it. The plunger 56 is urged by a spring 57 towards the holder 55. A working oil is introduced into the engaging hole 55*a* through a plunger oil channel 58.

When a working oil is introduced into the engaging hole 55*a*, the plunger 56 moves against the spring 57, so that the locking between the holder 55 and the plunger 56 is released. Reference numerals 59, 61 denote air holes. Reference numeral 60 denotes a shaft bolt rotatable relatively to the cover 48.

A first oil channel 62 and a second oil channel 63 extend through the cam shaft for the intake valve 19 and through the rotor 44. The first oil channel 62 communicates with an oil pressure chamber for timing retard (retarding chamber) 73, which serves to rotate the rotor 44 in the timing retard direction. The second oil channel 63 communicates with an oil pressure chamber for timing advance (advancing chamber) 74, which serves to rotate the rotor 44 in the timing advance direction. In this specification and the claims, the "timing retard direction" means the direction to increase the volume of the oil pressure chamber for timing retard 73, the counterclockwise direction in FIG. 26, and the "timing advance direction" means the direction to increase the volume of the oil pressure chamber for timing advance 74, the clockwise direction in FIG. 26. Both the pressure chambers 73, 74 will be explained later.

The working oil for the actuation of the actuator 40 is supplied through an oil control valve 80 (hereinafter called OCV), which controls the amount of oil to be sent to the actuator 40. The OCV 80 comprises a valve housing 81, a spool 82, which can slide in the valve housing 81, a spring 83 urging the spool 82 and a linear solenoid 84 to move the spool 82 against the biasing force of the spring. The working oil is supplied from a lubrication oil supplying apparatus, which is provided for supplying lubrication oil to each part of engine (not shown). The lubrication oil supplying apparatus is comprised of an oil pan 91, an oil pump 92 and an oil filter 93. The inlet port of the OCV 80 is connected with the oil filter 93 through an oil supply piping 85*a*. The outlet ports of the OCV 80 are connected with the first and second oil channels 62, 63 through a first piping 89 and a second piping 90. The working oil returns to the oil pan 91 through a drain piping 88. They constitute a working oil supplying apparatus to the actuator 40 together with the oil control valve OCV 80.

An electronic control unit 100 (hereinafter called ECU) controls an injector, an igniter, which are not shown, and the OCV 80, on the basis of signals from an intake air amount sensor, a throttle sensor, a water temperature sensor, a crank angle sensor, and a cam angle sensor, which are not shown. Thus, the ECU controls the fuel injection amount, the timing of the ignition, the timing of opening of the OCV 80 and the timing of the closing of the OCV 80 after the cut off of the ignition switch.

FIG. 26 is a cross sectional view of FIG. 23 along the line X—X. FIG. 27 is a cross sectional view in part, showing a state that a slide plate in FIG. 26 is displaced. FIG. 28 is a cross sectional view of FIG. 23 along the line Y—Y. FIG. 29 is a cross sectional view of FIG. 23 along the line Z—Z.

The rotor 44 has first to fourth vanes 64–67 projecting outwardly in the radial direction. The tips of the vanes 64–67 slide along the inner surface of the case 43, contacting with it. A chip seal 68, as a sealing element is disposed at the contacting portion of each vane 64–67. A back spring (not shown) is disposed between the vane 64–67 and the chip seal 68 so as to urge the chip seal towards the inner surface of the case 43, which is the counter surface of the chip seal. Shoes 71 are provided in the case 43, which are portions jutting inwardly at the inner surface of the case 43. A bolt hole 72 is disposed in the shoes 72, through which the bolt 49 shown in FIG. 23 is inserted.

The tip of each shoe 71 slides along the outer surface of a vane supporting portion 69, contacting with it. The vane supporting portion 69 supports the vanes.

Each space contoured by the inner surface of case 43 and the outer surface of the rotor 44 and limited by neighboring shoes 71 are divided by a vane 64–67 into an oil pressure chamber for timing retard 73 and an oil pressure chamber for timing advance 74. The oil pressure chamber for timing retard 73 serves to rotate the vanes in the timing retard direction, and the oil chamber for timing advance 74 serves to rotate the vanes in the timing advance direction. The cross section of each oil chamber 73, 74 has a substantially fan like form.

The oil pressure chamber for timing retard 73 and the oil pressure chamber for timing advance 74 are connected by a communicating channel 75. A groove 76, with which the plunger oil channel 58 communicates, is disposed in the communicating channel 75.

The communicating channel 75 is separated by a slide plate 77 disposed in this groove 76. The slide plate 77 prevents the oil leakage between the oil chamber for timing retard 73 and the oil chamber for timing advance 74.

The slide plate 77 is movable in this groove 76. When the pressure in the oil pressure chamber for timing retard is higher, the slide plate 77 moves towards the oil pressure chamber for timing advance, as shown in FIG. 26. On the other hand, when the pressure in the oil pressure chamber for timing advance is higher, the slide plate 77 moves towards the oil pressure chamber for timing retard 73, as shown in FIG. 27.

The arrows in FIGS. 26, 28, 29 show the rotation direction of the actuator 40 as a whole.

The oil pressure chamber for timing retard 73 and the oil pressure chamber for timing advance 74 are contoured by the housing 42, the case 43, rotor 44 and the cover 48. The oil pressure chamber for timing retard 73 is communicated with the first oil channel 62, through which the working oil is supplied. The oil pressure chamber for timing advance 74 is communicated with the second oil channel 63, through which the working oil is supplied. The rotor 44 rotates relatively to the housing 42, and the volumes of the oil pressure chambers 73, 74 change, in response to the oil amounts supplied into the oil pressure chambers 73, 74.

The functions of the actuator 40 and the oil control valve 80 are explained below.

When the engine is stopping, the rotor 44 is at the maximum timing retard position, as shown in FIG. 26. Namely, the rotor 44 is rotated relatively to the housing 42 up to the maximum timing advance position. The volume of the oil pressure chamber for timing retard is at the maximum. As the oil pump 92 is stopping, no working oil is supplied neither to the first oil channel 62 nor to the second oil channel 63. Therefore, no working oil is supplied into the plunger oil channel 58, and the oil pressure in the actuator 40 is low. As a result, the plunger 56 is pressed toward the holder 55 by the biasing force of the spring 57, so that the engaging shaft portion 56*a* of the plunger 56 engages with the engaging hole 55*a* of the holder 55, namely, the housing 42 and the rotor 44 are engaging to each other.

When the engine begins to run starting from this state, the oil pump 92 works to increase the pressure of the working oil to be supplied to the OCV 80. Then a working oil is supplied into the timing retard oil pressure chamber 73 in the actuator 40 via the first piping 89 and the first oil channel 62. The oil pressure in the timing retard oil pressure chamber 73 causes a displacement of the slide plate 77 towards the timing advance oil pressure chamber 74. Therefore, the oil pressure chamber for timing retard 73 and the plunger oil chamber 58 communicates to each other so that the working oil is supplied into the engaging hole 55*a* of the holder 55 via the plunger oil channel 58. As a result, the plunger 56 is pressed and is forced to move against the biasing force of the spring 57, so that the engaging shaft portion 56*a* of the plunger 56 go out from the engaging hole 55*a* of the holder 55. Namely, the locking between the plunger 56 and the rotor 44 is released.

Because a working oil is supplied into the oil pressure chamber for timing retard 73, the vanes 64–67 of the rotor 44 are pressed against the shoes 71 from the timing retard direction. Therefore, the housing 42 and the rotor 44 press to each other due to the oil pressure in the oil pressure chamber for timing retard 73, even after the locking between the plunger 56 and the rotor 44 is released. As result, the vibration of the rotor or the bumping between them do not occur.

When the rotor 44 shall be rotated in the timing advance direction, a working oil is supplied into the oil pressure chamber for timing advance 74, via the second piping 90 and the second oil channel 63, under the control of the oil control valve 80. The oil pressure in the oil pressure chamber for timing advance 74 causes to displace the slide plate 77 towards the oil pressure chamber for timing retard 73. As a result, the plunger oil channel 58 communicates with the oil pressure chamber for timing advance 74 through the communicating channel 75. The oil pressure in the oil pressure chamber for timing advance 74 causes a displacement of the plunger 56 towards the housing 42 against the biasing force of the spring 57. Namely, the locking between the plunger 56 and the holder 55 is released.

While the locking is released, the position of the rotor 44 relative to the rotor 44 is varied and adjusted in either of the timing advance direction or the timing retard direction. The amount of the oil supply is adjusted by opening and closing of the oil control valve 80, which adjusts the oil amount in the oil pressure chambers 73, 74, so that the rotor 44 is rotated relatively to the housing 44. FIG. 27 shows the state that the rotor 44 is rotated up to the maximum timing advance position, to contact with a shoe 71 from the oil pressure chamber for timing retard 73 side. In this state, the vanes 64–67 of the rotor 4 are rotating. When the oil pressure in the oil pressure chamber for timing retard 73 is larger than that in the oil chamber for timing advance 74, the rotor 44 rotates relatively to the housing 42 in the timing retard direction.

As explained, the rotor 44 can be adjusted to rotate in the timing retard direction or in the timing advance direction relatively to the housing 42, by controlling the amount of oil to be supplied to the oil pressure chambers 73, 74. And the chip seals 46, 68 function to prevent the leakage of working oil between the oil pressure chambers 73, 74.

The oil control valve 80 is feed-back controlled by the electronic control unit 100, on the basis of the signals from a position sensor, which detects the rotation angle of the rotor 44 relative to the housing 42, and a crank angle sensor, which decides the output pressure of the oil pump 92.

The vane type hydraulic actuator of the prior art has a drawback, due to such a structure, that a biasing force generating means, for example, a spring 47 is necessary for pressing the chip seals 46, 68 for the tight contact between the vanes and the casing. This entails an increase of the number of the fabrication elements and the increase of the number of steps for assembling them. Thus the productivity is low and the production cost is high.

A complex mechanism, using an oil pressure delivery mechanism, for example, a slide plate 77, is necessary for releasing the locking means for suppressing the rotation, for example, a plunger 56. Namely the apparatus is complex, and productivity is low.

SUMMARY OF THE INVENTION

An object of the present invention is to eliminate these drawbacks of the vane type hydraulic actuator of the prior art.

Another object of the present invention is to provide a vane type hydraulic actuator, in which a force can be imposed to the chip seals to contact tightly with its counter surface, without using a supplemental biasing force generating means, for example, a spring, so that the productivity can be improved, and the production cost can be reduced.

Further another object of the present invention is to provide a vane type hydraulic actuator, in which the locking means of the rotation, for example, a plunger, can be released easily, without using a complex mechanism, such as a slide plate.

A vane type hydraulic actuator according to the present invention comprises:

a housing rotatably fixed on a rotation shaft;

a case having an inner space therein, the case is fixed to the housing;

a rotor fixed to the shaft and received in the inner space of the case, the rotor having a plurality of vanes for forming oil pressure chambers, and controlling the rotation angle of the rotation shaft relative to the housing, on the basis of the oil pressures delivered in the oil pressure chambers;

chip seals disposed at the contacting portion between the rotor and the case, each of which is received in a seal groove, the chip seals are disposed on the rotor side as well as on the case side; wherein the hydrodynamic resistance of the working oil at the seal gap between the tip of the sealing element, which is received in a seal groove, and the counter surface, where the sealing element contacts, is larger than that at the gap between the flank of the sealing element and the flank of the receiving groove.

In a vane type hydraulic actuator according to an embodiment, the seal distance between the tip of the sealing element and the counter surface is smaller than the distance of the gap between the flank of the sealing element and the flank of the receiving groove, and the seal distance between the tip of the seal element and the counter surface is smaller than the distance of the gap between the rotor and the case.

In a vane type hydraulic actuator according to an embodiment the edge of the seal groove is chamfered to be round or flat.

In a vane type hydraulic actuator according to an embodiment, the flanks of the seal groove are tapered so that the width of the groove is larger at the outer portion of the groove.

In a vane type hydraulic actuator according an embodiment, the sealing element has a form of box having a hollow portion at its bottom.

In a vane type hydraulic actuator according an embodiment, the rotor further comprising a locking means for suppressing the rotation of the rotor relative to the housing, an unlocking means for releasing the suppression of the rotation by the locking means, and an oil channel connecting between the bottom of the seal groove and the unlocking means, for supplying a working oil into the locking means so as to release the suppression of the rotation.

BRIEF DESCRIPTION OF THE DRAWINGS

FIG. 3(*a*) is a front view of the actuator at a state the cover is removed.

FIGS. 3(*b*) and 3(*c*) are perspective views of the seal groove and chip seal.

DETAILED DESCRIPTION OF THE PREFERRED EMBODIMENTS

Embodiment 1

Figure 1:
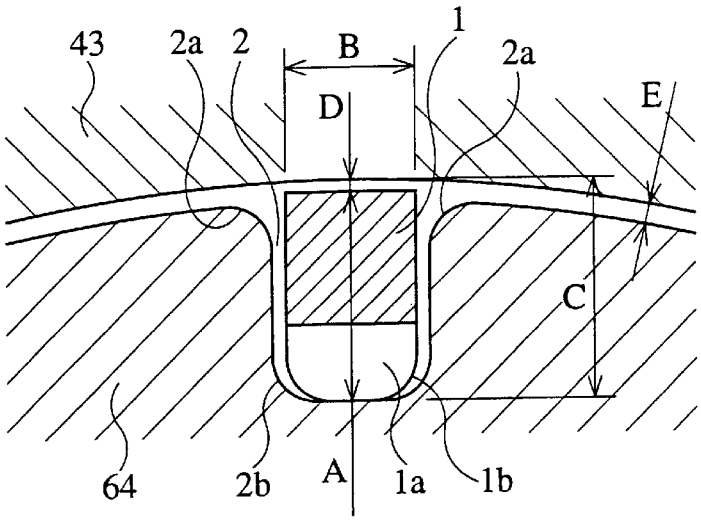
FIG. 1 is a detailed cross sectional view of a chip seal and seal groove used in a vane type hydraulic actuator according to the embodiment 1 of the present invention.
Figure 2:
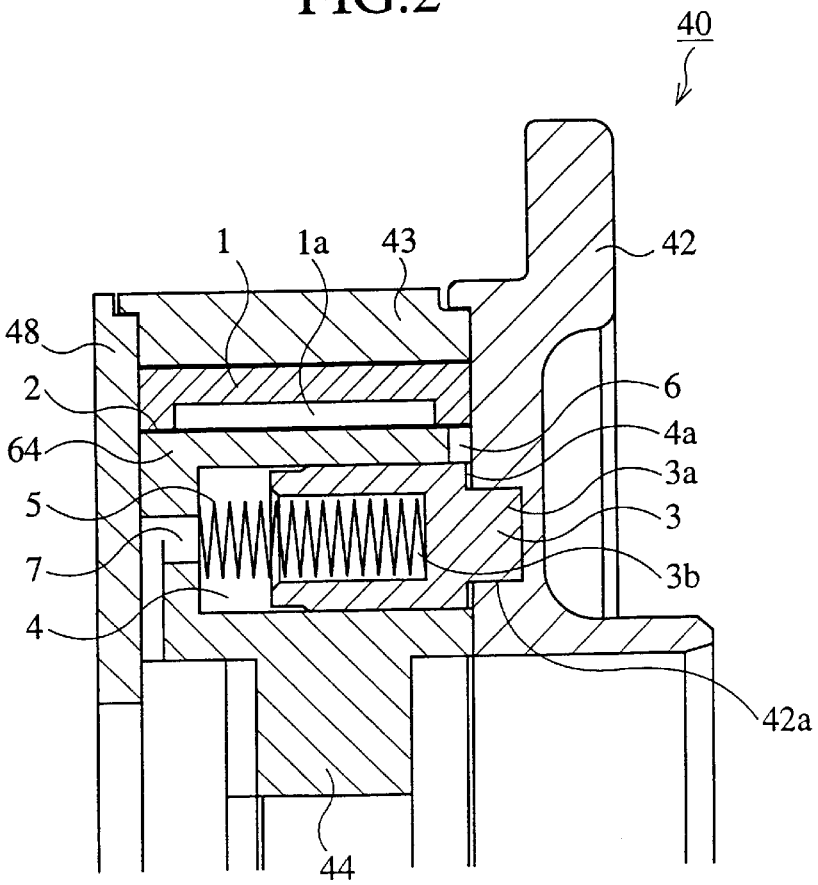
FIG. 2 is a detailed cross sectional view of the main part of the actuator of FIG. 1.
Figure 4:
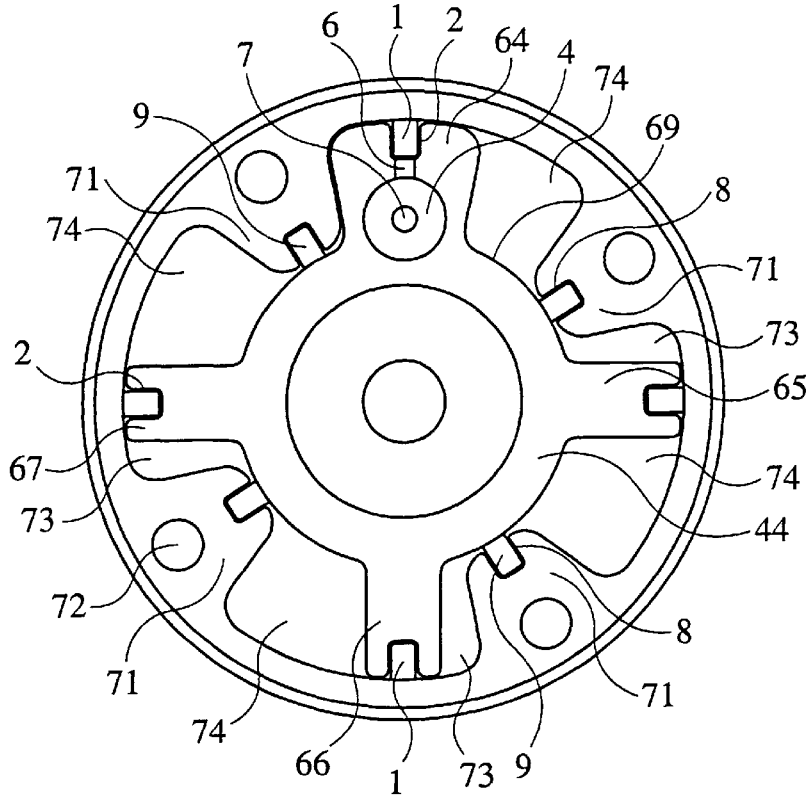
FIG. 4 is a front view of the actuator at a state the housing is removed.

The embodiment 1 is explained below, referring to FIGS. 1–9.

The elements identical or equivalent with the elements in the explanation of the prior art are referred by the same reference numerals, and their explanation is omitted.

Figure 5:
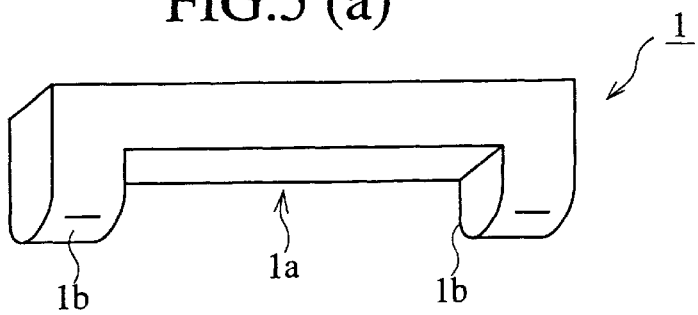
FIGS. 5(*a*) and 5(*b*) are a perspective views of a chip seals.
Figure 5:
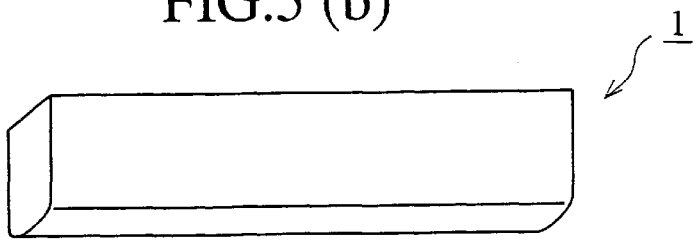

Reference numeral 1 denotes a chip seal as a sealing element. The chip seal 1 is formed as a substantially square prism. Perspective views of the chip seal are shown in FIG. 5. The chip seal 1 can have a recessing portion 1*a* at its bottom. And its both end portions can be chamfered, as shown in FIG. 5(*a*). However, the chip seal 1 can be a simple square prism bar having no recessing portion, as shown in FIG. 5(*b*).

Reference numeral 2 denotes a seal groove for receiving the chip seal. The seal groove 2 is disposed at the tip of each vane 64–67. Perspective view of the seal groove and the chip seal received in it are shown in FIG. 3. The groove can be parallel with the rotor axis, namely the width can be constant, as shown in FIG. 3(*b*). However, the groove can be tapered in the rotor axis direction, as shown in FIG. 3(*c*), and a part of the chip seal 1 can protrude from the seal groove 2. The seal groove 2 has a round chamfered portion 2*a* at its upper edging portion and a round corner 2*b* at its bottom portion.

Reference numeral 3 is a stopper pin for locking the rotor 44. The stopper pin 3 has an engaging portion 3*a* at an end and a spring holding hole 3*b* at the other end. The stopper pin is received in a stopper pin holding hole 4, which is disposed in the rotor 44. Even when the engaging portion 3*a* is completely engaging with the housing 42, there is a gap 4*a*. As will be explained later, a working oil can be introduced into the gap 4*a* from an oil channel 6 so as to impose a force to the stopper pin towards a spring 5.

The stopper pin 3 is always urged by the spring 5 toward the housing 42, so that the engaging portion 3*a* engages with an engaging recession 42*a*, which is disposed in the housing 42. The stopper pin 3 and the spring 5 constitute a locking means. The stopper pin holding hole 4 belongs to an unlocking means.

The stopper pin holding hole 4 is connected with the seal groove 2 through an oil channel 6. The working oil from the seal groove 2 is introduced into the stopper pin holding hole 4 so as to unlock the engagement between the engaging portion 3*a* and the engaging recession 42*a*. The space where the spring 5 is found is communicated with the atmosphere through a drain channel 7.

Figure 6:
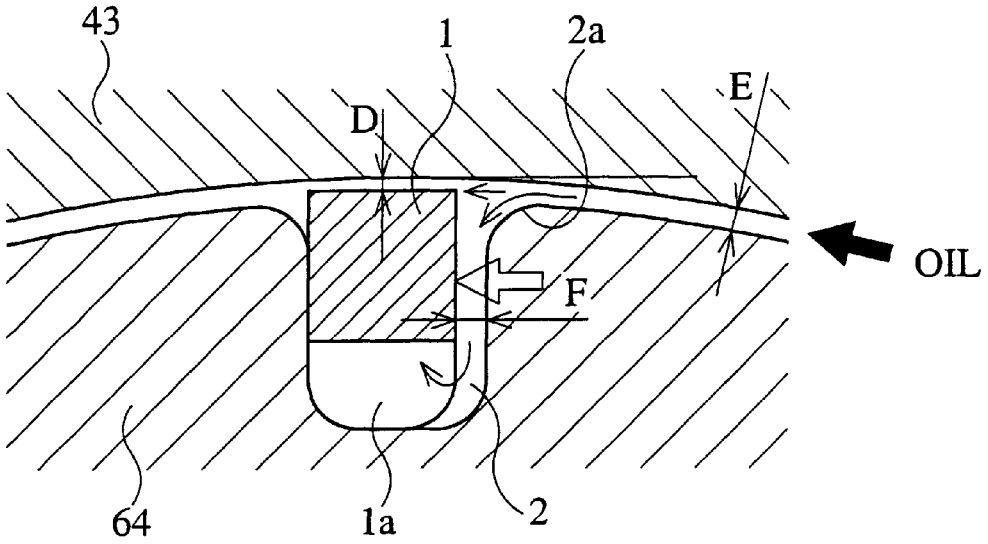
FIGS. 6 and 7 are cross sectional views of the chip seal and the groove, showing how they function when an oil pressure is imposed.
Figure 7:
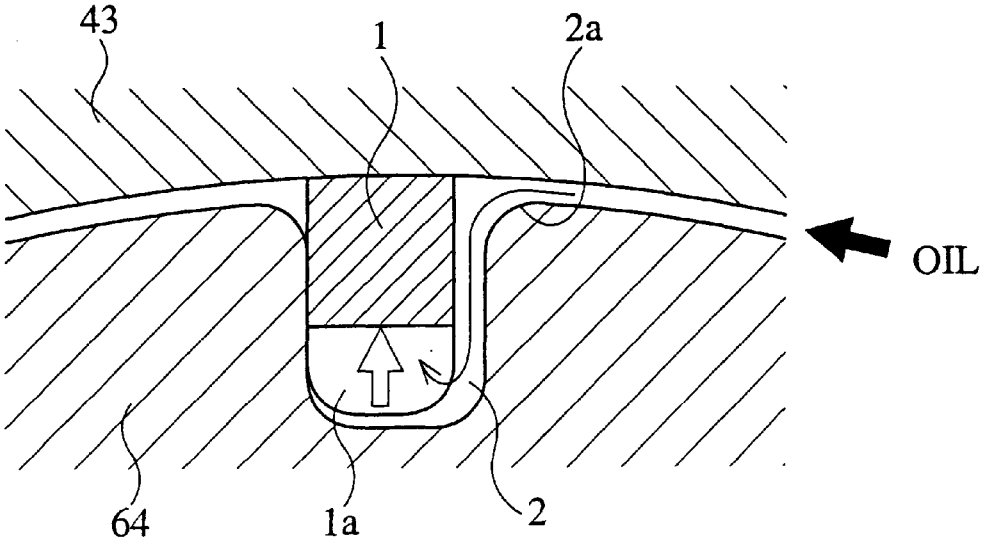

The conditions regarding to the size of these elements are explained below. Referring to FIG. 1, the height and the width of the chip seal are referred by A, B, respectively. The distance between the bottom of the seal groove 2 and the inner surface of the case where the chip seal contacts is referred by C. The distance of the gap between the tip of the chip seal 1 and the inner surface of the case 43 where the chip seal can contact is referred by D. The distance between the vane (for example, first vane 64) and the inner surface of the case 43 where the chip can contacts is referred by E. Referring to FIG. 6, the distance between the flank of the chip seal 1 and a flank of the seal groove 2, at a state that the other flank of the chip 1 is contacting with the other flank of the seal groove, is referred by F.

According to the embodiment 1 of the present invention, the dimensions of these sizes A,B,C,D,E and F are defined so that the hydrodynamic resistance of the working oil at the gap D is larger than that in the gap F, namely E>D, and F>D.

The other vanes 65–67 have a similar seal groove 2 and a similar chip seal 1, as the vane 64 has. Moreover, also each shoe 71 of the case 43 has a seal groove 8 and a chip seal 9 as a seal element disposed in it, similar to the seal groove 2 and the chip seal 1 of the vanes 64–67.

The structure of the other part of the vane type hydraulic actuator of the present invention is identical to that of the prior art. Thus, the explanation regarding to the part other than the chip seal and the seal groove is omitted for avoiding the redundancy.

The function of the hydraulic actuator of the present invention is explained below.

The principle of the function of the chip seal 1:

When no hydraulic force is imposed, the chip seal is positioned at the middle portion of the seal groove, as shown in FIG. 1. When a working oil is introduced, as shown in FIG. 6, into a gap between the tip of the first vane 64 and the inner surface of the case 43, from either of the oil pressure chamber for timing advance 74 or the oil pressure chamber for timing retard 73, the working oil flows mainly through the gap F, due the hydrodynamic resistance in the gaps D and F, under the aforementioned conditions of the dimension. Therefore, the chip seal 1 is pressed towards a flank of the seal groove 2, as shown by a white arrow in the figure. Simultaneously, the working oil flown into the recessing portion 1*a* presses the chip towards the case 43.

As a result, the tip of the chip seal 1 contacts with the inner surface of the case 43 by the oil pressure caused by the working oil in the recessing portion 1*a*, namely the sealing force between them can be assured.

The round chamfered edge 2*a* of the seal groove 2 functions to lead easily the working oil into the gap F and the recessing portion 1*a*, hence, the sealing force can be assured promptly.

The oil pressure delivery by the chip seal 1 is explained below.

Figure 8:
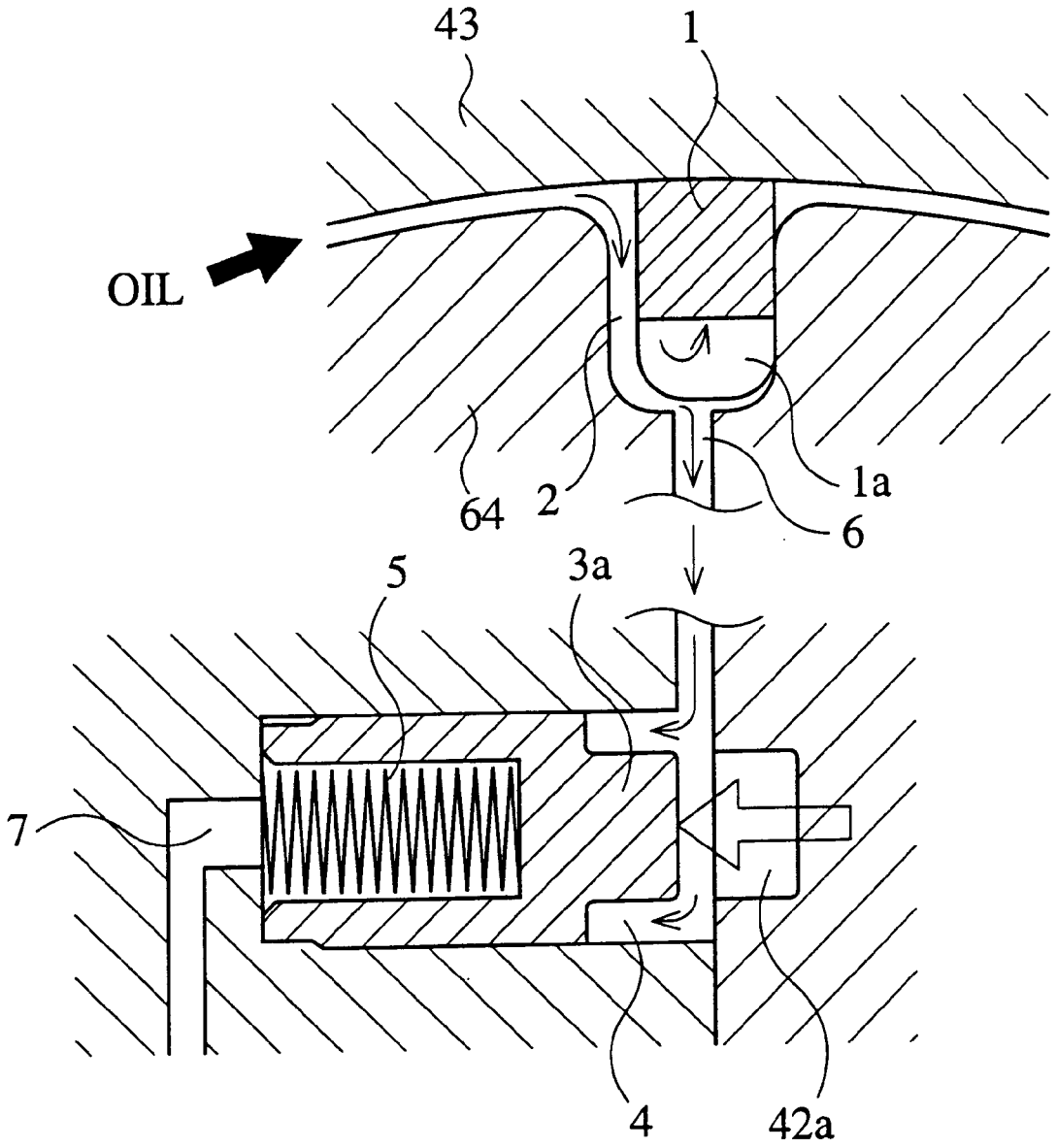
FIGS. 8 and 9 are cross sectional views of the chip seal and the seal groove, showing how a working oil is delivered.

As shown in FIG. 8, a working oil supplied either from the oil pressure chamber for timing advance or for timing retard (not shown), flows into the oil channel 6, pressing the chip seal 1 towards the case 43 to assure the sealing force. The oil channel (6) can be formed as a groove disposed at an end face of the rotor (44) in the longitudinal direction. The working oil reached to the stopper pin holding hole via the oil channel 6 presses the stopper pin 3 towards the spring 5 against the biasing force of the spring 5, so that the stopper pin 3 displaces as shown by a white arrow in the figure so as to release the engagement between the engaging shaft portion 3*a* and the engaging recession 42*a*.

Figure 9:
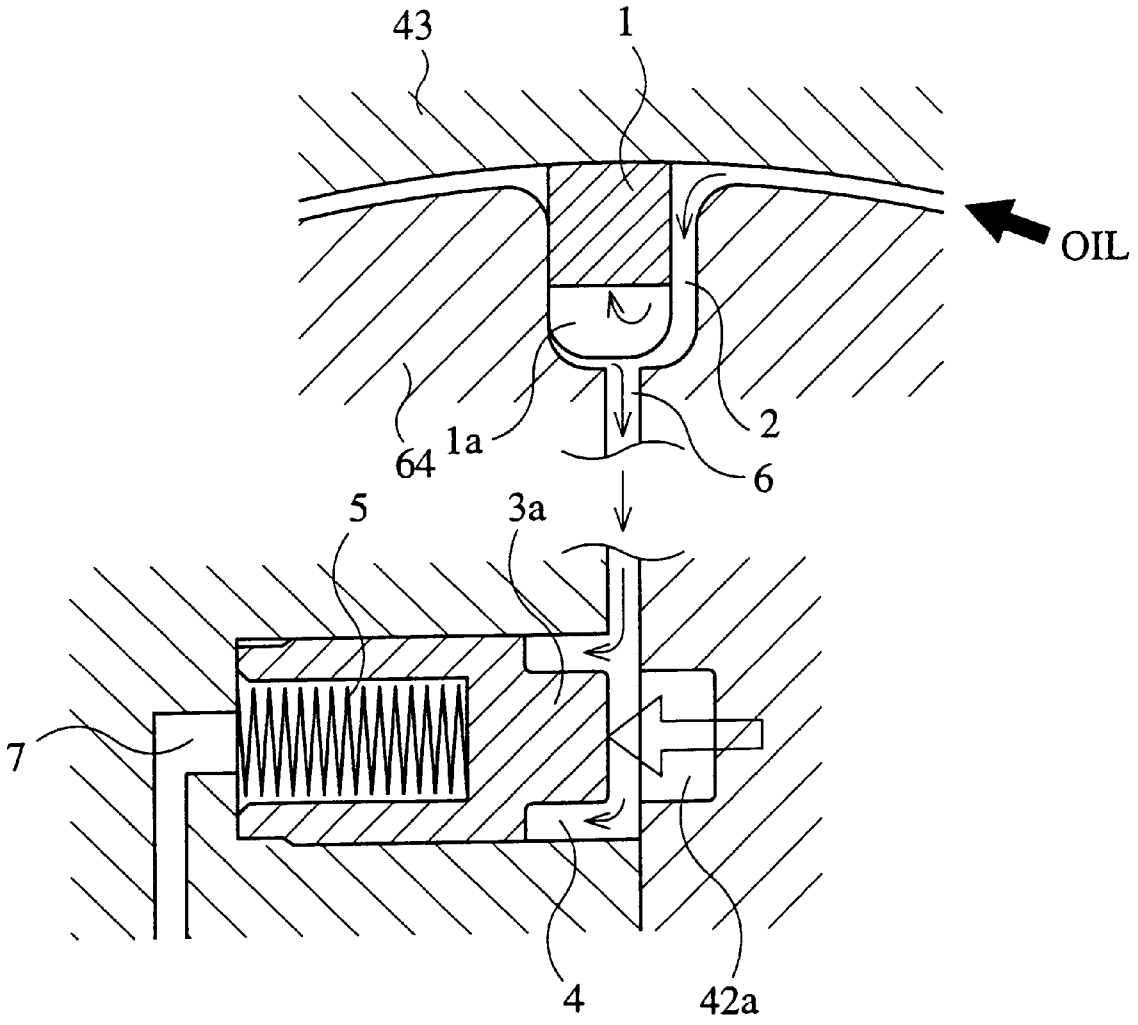

In the same way, when the working oil is supplied from the opposite direction as shown in FIG. 9, the working oil releases the engagement between the engaging shaft portion 3*a* and the engaging recession 42*a*, assuring the sealing force between the sealing element and its counter surface.

The other functions of the hydraulic actuator of the present invention are identical to that of the prior art. Thus their explanation is omitted for avoiding the redundancy.

According to the embodiment 1 of the present invention, no supplemental pressing means, for example, a spring for urging the chip seal towards the case 43 as in the prior art, is necessary. The chip seal can be easily pressed to contact tightly with the case 43 and functions as a sealing element, due to an oil pressure at the bottom of the chip seal. Therefore, the number of fabrication elements and the number of steps to assemble them can be reduced, thus the productivity can be improved. As a result, the production cost can be reduced.

Moreover, as the engagement between the engaging portion 3*a* and the engaging recession 42*a* can be easily released, by shifting the chip seal and by delivering the working oil to the stopper pin 3, no supplemental oil pressure delivering means, for example, a slide plate 77 in the prior art, is necessary. Therefore, the number of the fabrication elements can be reduced.

The embodiment 1 was explained, supposing that the chamfered portion 2*a* is round, however, the portion can be a plane.

Embodiment 2

The embodiment 2 of the present invention is explained below, referring to FIGS. 10–17.

The flanks of the seal groove 2 form tapering portions 2*c* tapered at a tapering angle θ. The width of the groove 2 is wider at the case 43 side. The distance between an outer edge of the chip seal 1 and its diagonal inner round chamfered edge 1*b* of the chip seal 1 is referred by G . The definitions of the other sizes A to F are identical to that in the embodiment 1.

In the embodiment 2, the dimensions of the sizes shown in the figure are defined so that the hydrodynamic resistance in the gap D is larger than that in the gap between the chip seal 1 and the tapered portion 2*c*. Namely, $$E>D, \text{ and } D<A\cdot\tan\theta,$$

or $$E>D, \text{ and } A<C<G$$

The structure of the other portion of the hydraulic actuator of the embodiment 2 is similar to that of the embodiment 1, thus their explanation is omitted for avoiding the redundancy.

The function of the hydraulic actuator of the embodiment 2 is explained below.

Figure 10:
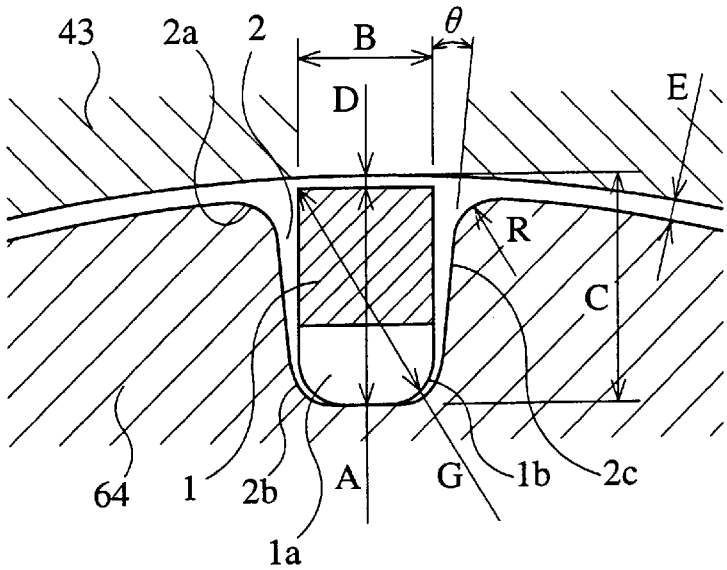
FIG. 10 is a detailed cross sectional view of a chip seal and seal groove used in a vane type hydraulic actuator according to the embodiment 2 of the present invention.
Figure 11:
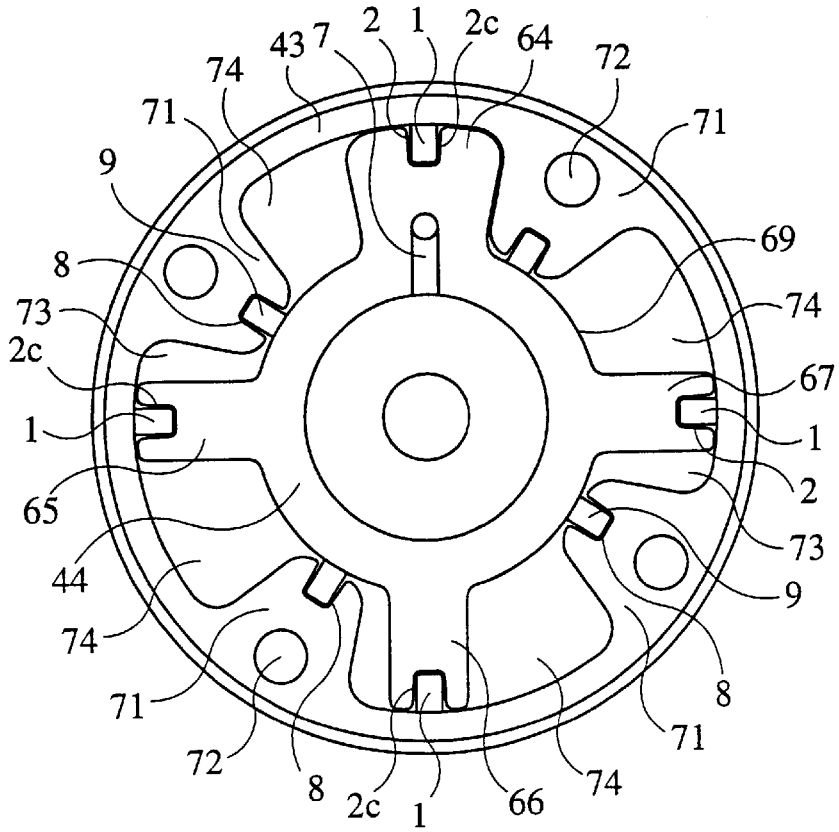
FIG. 11 is a front view of the actuator at a state the cover is removed.
Figure 12:
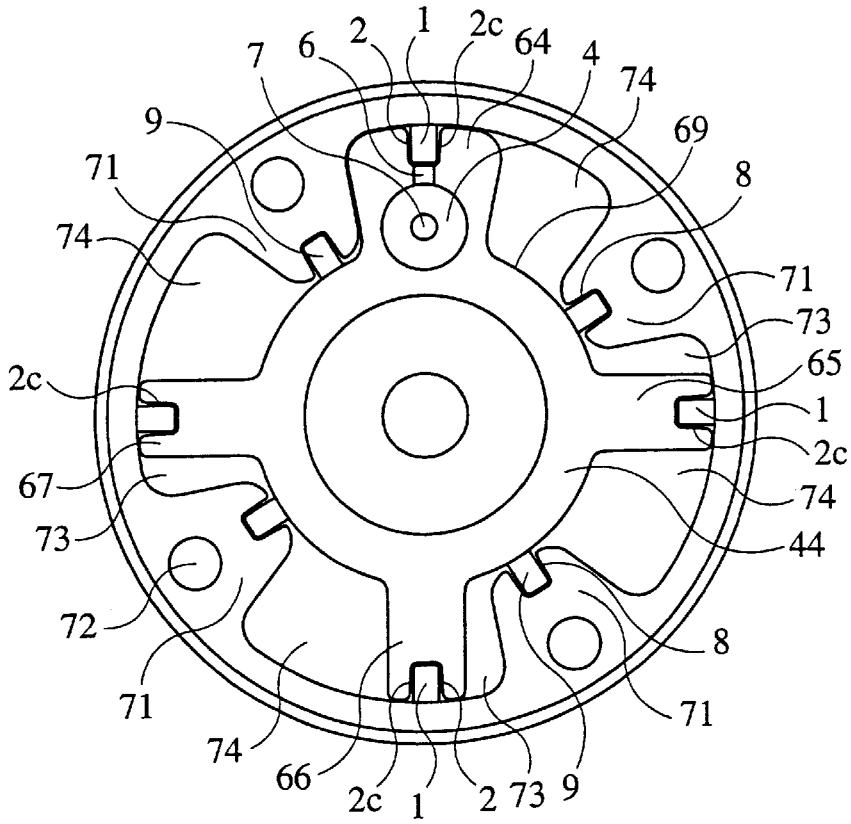
FIG. 12 is a front view of the actuator at state the housing is removed.
Figure 13:
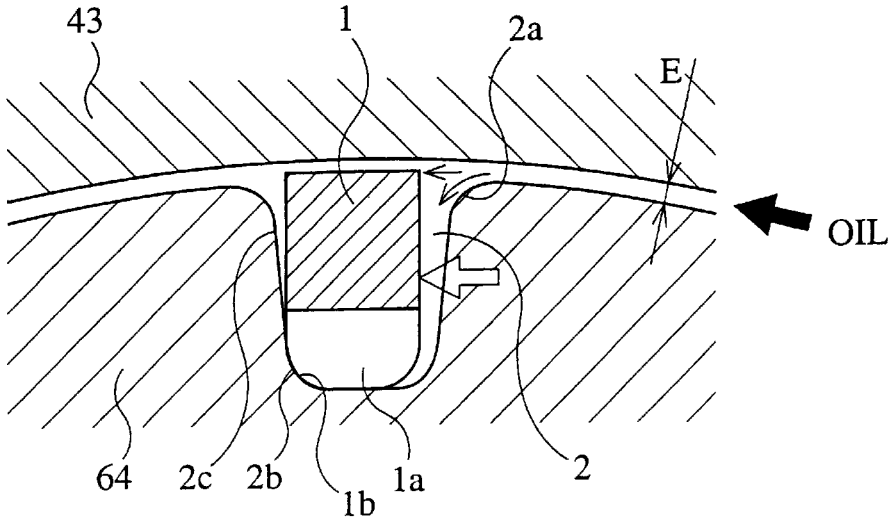
FIGS. 13–15 are cross sectional views of the chip seal, showing how they function when a hydraulic power is imposed.

When no hydraulic force is imposed, the chip seal is positioned at the middle portion of the seal groove, as shown in FIG. 10. When a working oil is introduced, as shown in FIG. 13, into the gap E between the tip of the first vane 64 and the inner surface of the case 43, from either of the oil pressure chamber for timing advance 74 or the oil pressure chamber for timing retard 73, the working oil flows mainly through the gap between the chip seal 1 and the tapered portion 2*c* of the groove, because the hydrodynamic resistance in the gap D is larger than that in the gap between the chip seal 1 and the tapered portion 2*c*, under the aforementioned conditions of the dimension.

Figure 14:
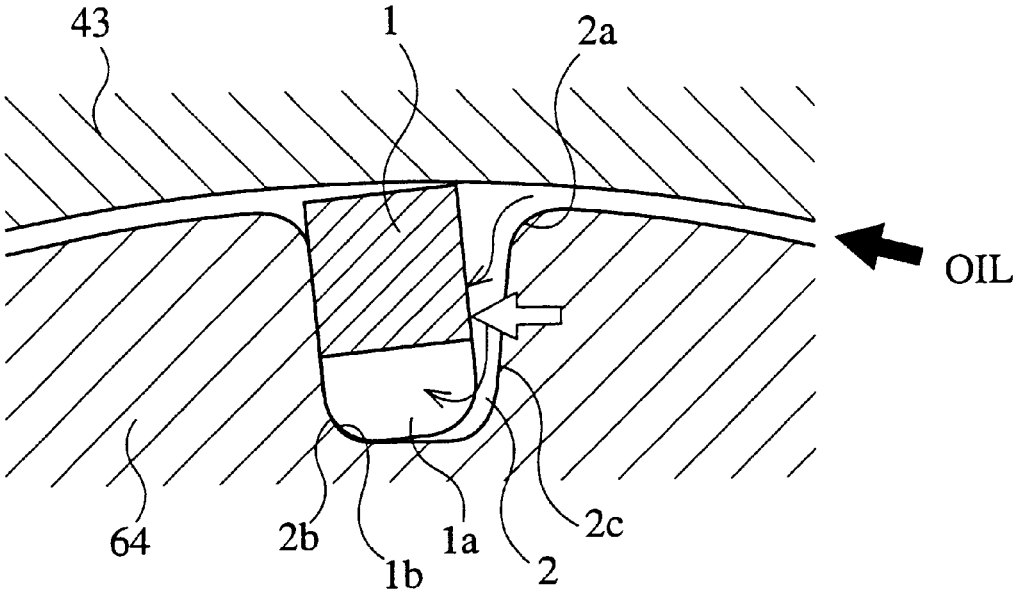

Therefore, the chip seal 1 is pressed towards a flank of the seal groove 2, as shown by a white arrow in the figure, and the chip seal 1 tilts as shown in FIG. 14. When the chip seal 1 tilts, an edge of the tip portion of the chip seal 1 contacts with the inner surface of the case 43, and the gap D, which was found at the initial state, disappears. Then, the working oil flows into the gap between the chip seal 1 and the tapered portion 2*c* to reach to the recessing portion 1*a*, and presses the chip seal towards the case 43.

Figure 15:
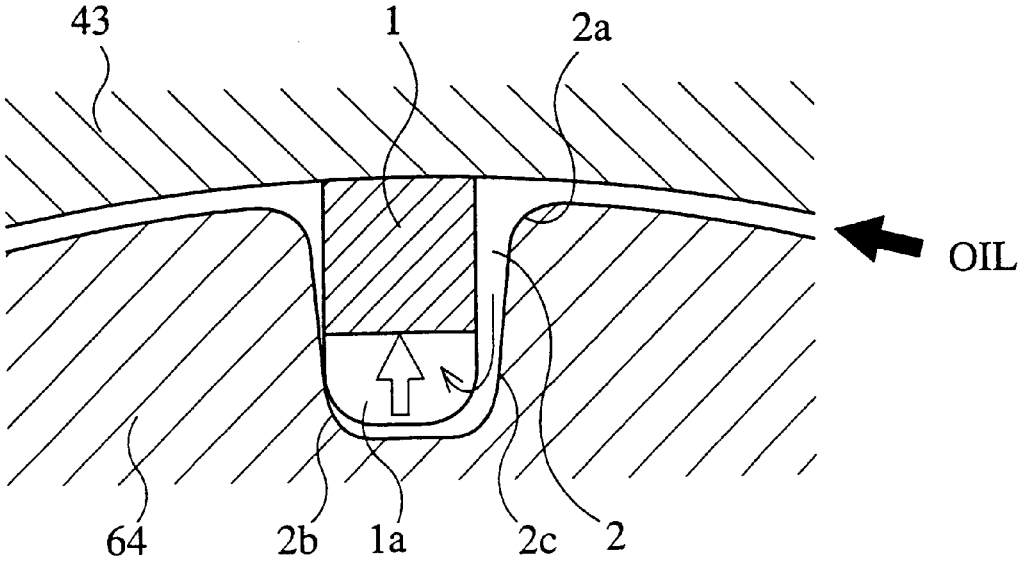

As a result, the tip of the chip seal 1 contacts tightly with the inner surface of the case 43, as shown in FIG. 15, by the oil pressure caused by the working oil in the recessing portion 1*a*, namely the sealing force between them can be assured.

The chip seal 1 can easily tilt in the seal groove 2, because of the tapered portion 2*c* of the seal groove 2. When the chip seal tilts, the width of the gap between the chip seal 1 and the tapered portion 2*c* rapidly increases, and the working oil can enter easily into the recessing portion 1*a*. Thus, the seal force can be more promptly assured.

The delivery of the oil pressure to the stopper pin 3 using the chip seal 1 is explained below.

Figure 16:
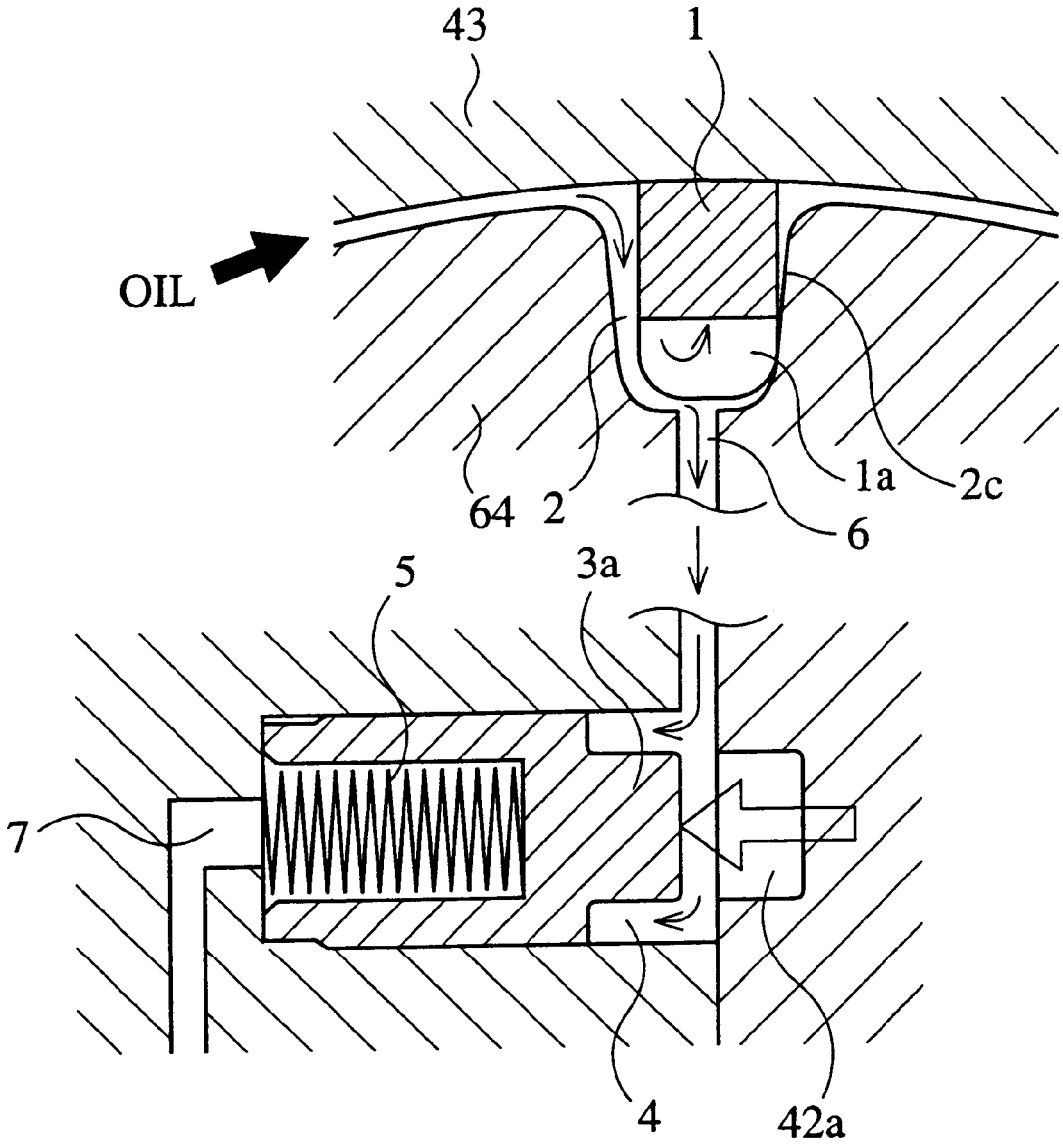
FIGS. 16 and 17 are cross sectional views of a chip seal and a seal groove, showing how a working oil is delivered

As shown in FIG. 16, a working oil supplied either from the oil pressure chamber for timing advance or for timing retard (not shown) flows into the oil channel 6, pressing the chip seal 1 towards the case 43 to assure the sealing force. The working oil reached to the stopper pin holding hole 4 via the oil channel 6 presses the stopper pin 3 towards the spring 5 against the biasing force of the spring, so that the stopper pin 3 displaces as shown by a white arrow in the figure so as to release the engagement between the engaging shaft portion 3*a* and the engaging recession 42*a*.

Figure 17:
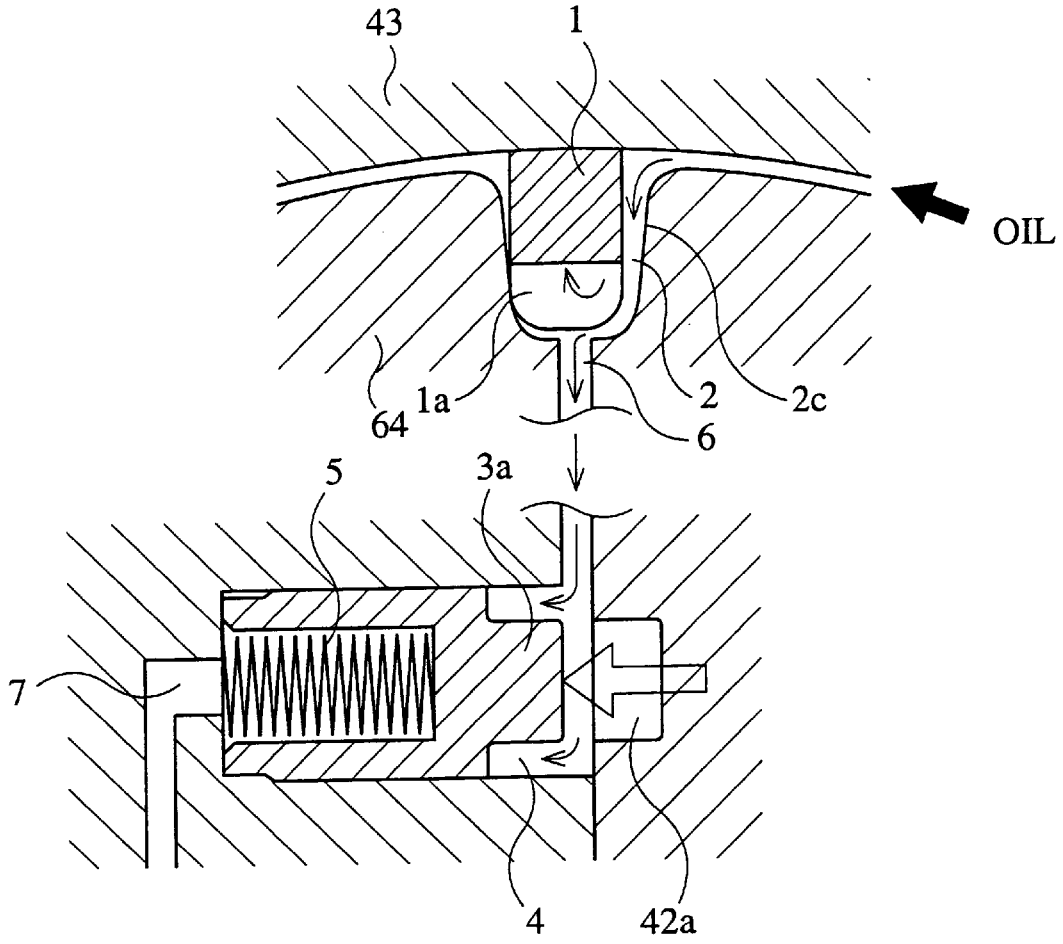

In the same way, when the working oil is supplied from the opposite direction as shown in FIG. 17, the working oil, assuring the sealing force, releases the engagement between the engaging shaft portion 3*a* and the engaging recession 42*a*, similarly to the case of FIG. 16.

According to the embodiment 2 of the present invention, the following advantage can be obtained, in addition to the advantages of the embodiment 1, that the working oil can promptly enter into the recessing portion 1*a*, by the tilt of the chip seal 1 in the seal groove 2 having a tapered portion 2*c*. Namely, the sealing force of the chip seal 1 can be promptly assured.

The embodiment 2 was explained, supposing that the chip seal 1 has a recessing portion 1*a*. However, the recessing portion 1*a* is not inevitable for the chip seal 1.

Embodiment 3

The embodiment 3 is explained below, referring to FIGS. 18–22.

The chip seal 1 has a hollow portion 1*c* at its bottom side, so that the center of the gravity of the chip seal 1 as well as the oil pressure acting plane become nearer to the inner surface of the case 43. The structure of the other part of the hydraulic actuator of this embodiment is identical to that of the embodiment 2, thus their explanation is omitted here for avoiding the redundancy.

The function of the chip seal according to the embodiment 3:

The essential functions are similar to that of the embodiment 2. The different point is that the oil pressure acting plane becomes nearer to the inner surface of the case 43, because the working oil can enter into the hollow portion 1*c* at the bottom portion of the chip seal. The acting plane of the force to displace the chip seal becomes nearer to the inner surface of the case 43, therefore, the gap between the tip portion of the chip seal and the inner surface promptly disappears. As a result, a stable sealing force can be assured.

Figure 18:
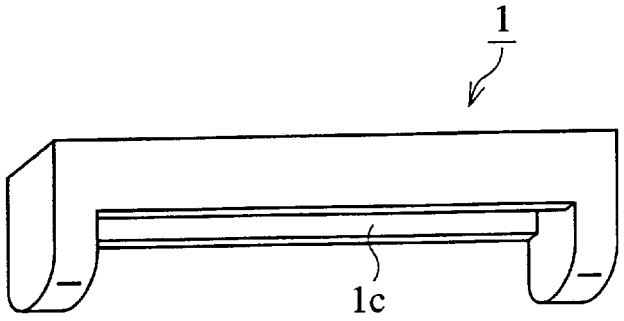
FIG. 18 is a perspective view of a chip seal of a vane type hydraulic actuator according to the embodiment 3 of the present invention.
Figure 19:
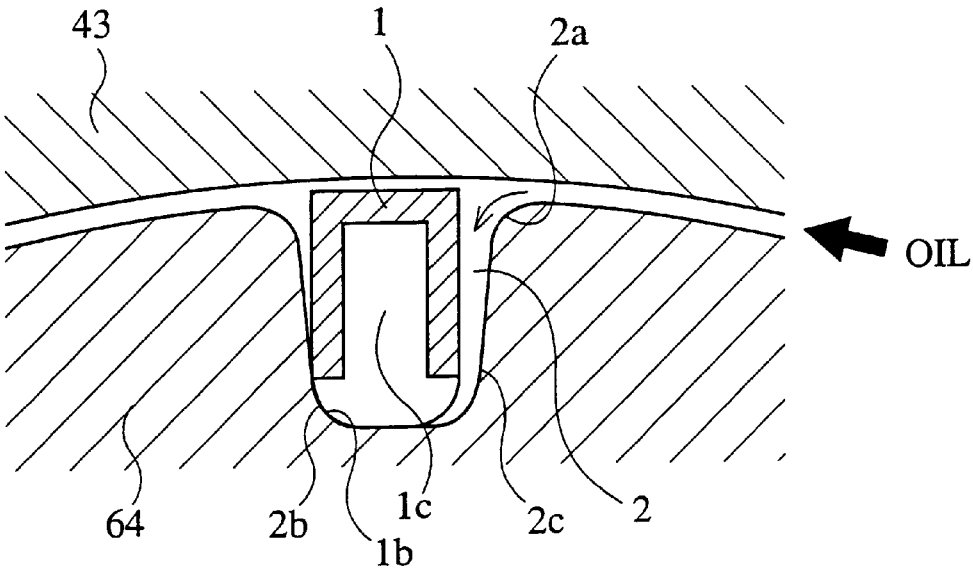
FIGS. 19–21 are detailed cross sectional view of the chip seal, showing how it function when an oil pressure is imposed.
Figure 20:
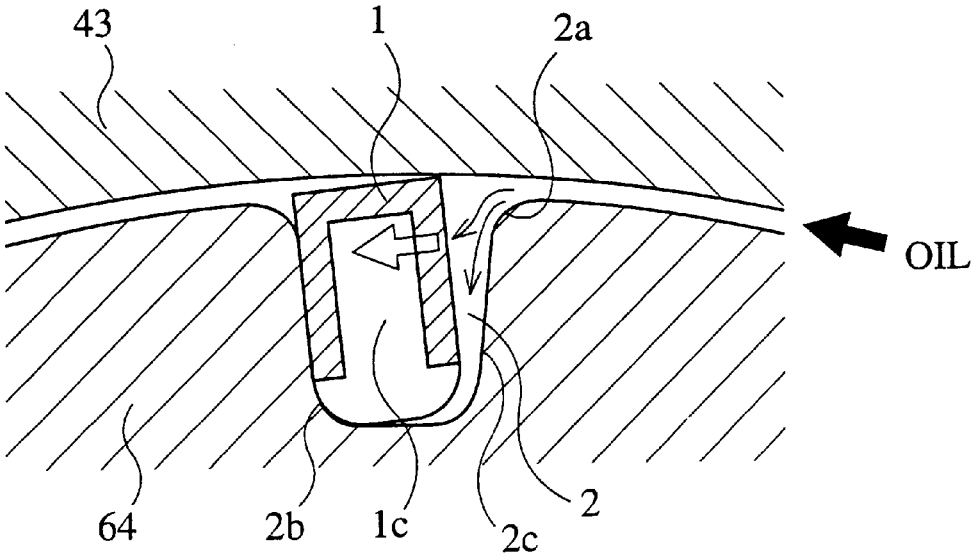
Figure 21:
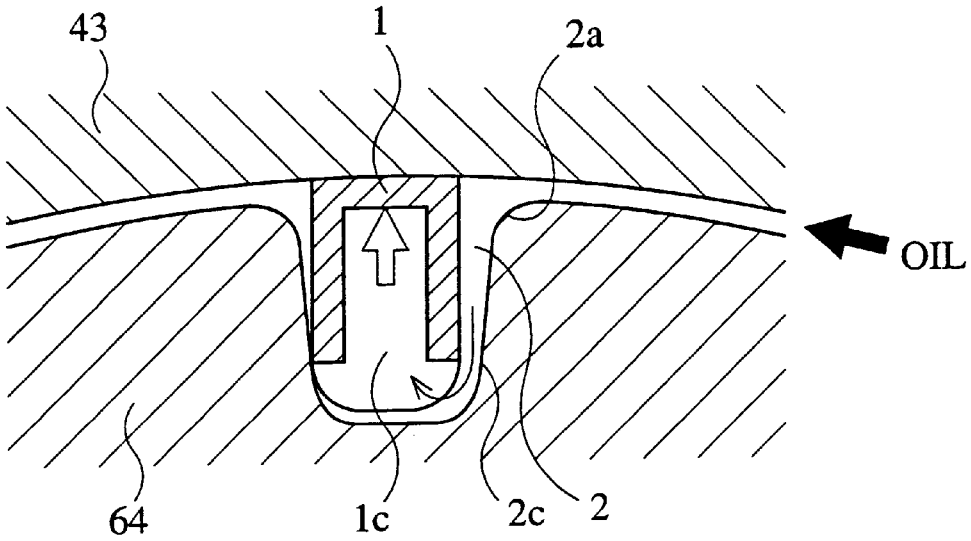
Figure 22:
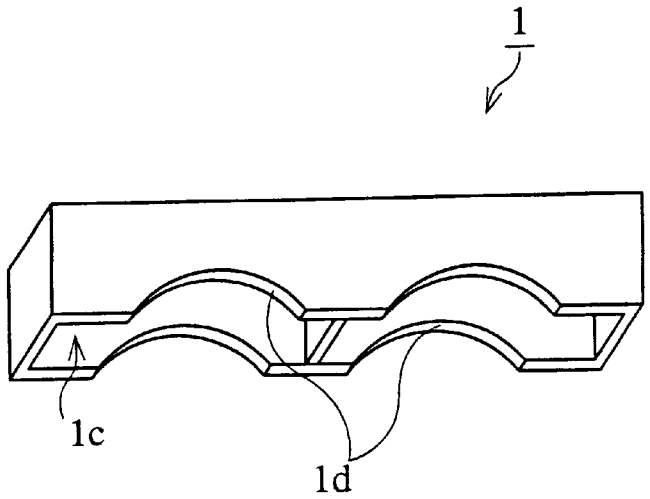
FIG. 22 is a perspective view of another shape of the chip seal.
Figure 23:
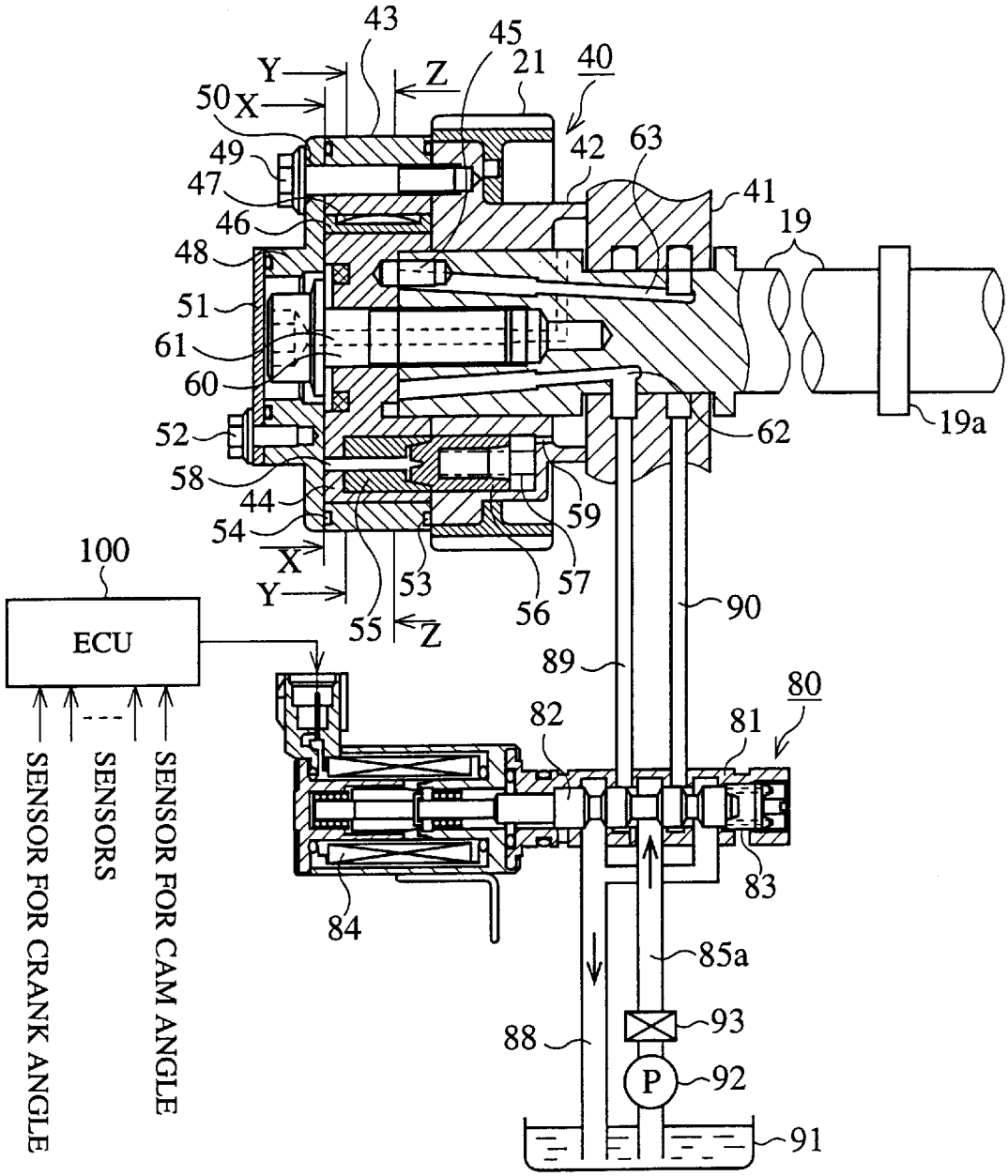
FIG.23 (PRIOR ART)
FIG. 23 is a cross sectional view of a vane type hydraulic actuator of the prior art.
Figure 24:
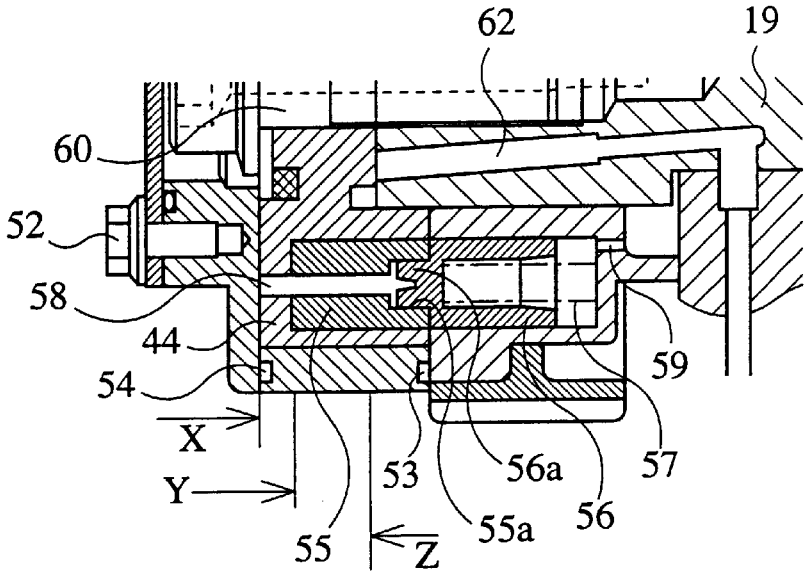
FIG.24 (PRIOR ART)
FIG. 24 is a detailed cross sectional view of the plunger portion of the actuator shown in FIG. 23, which is a main portion of the actuator.
Figure 25:
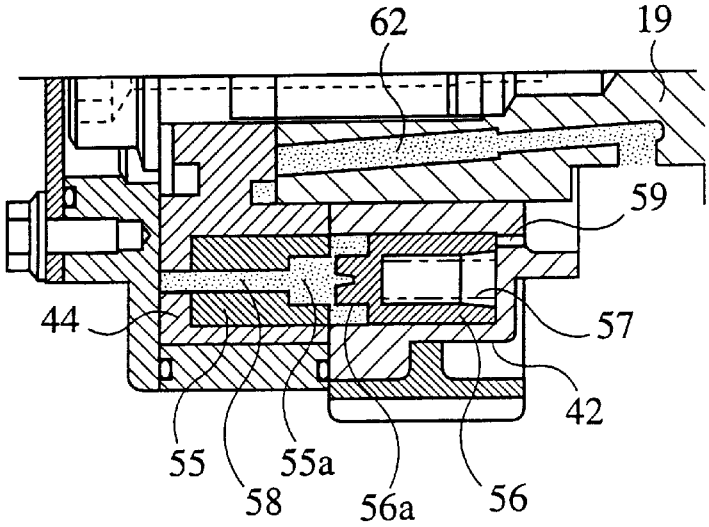
FIG.25 (PRIOR ART)
FIG. 25 is a cross sectional view of the plunger portion shown in FIG. 24, at a state when an oil pressure is applied.
Figure 26:
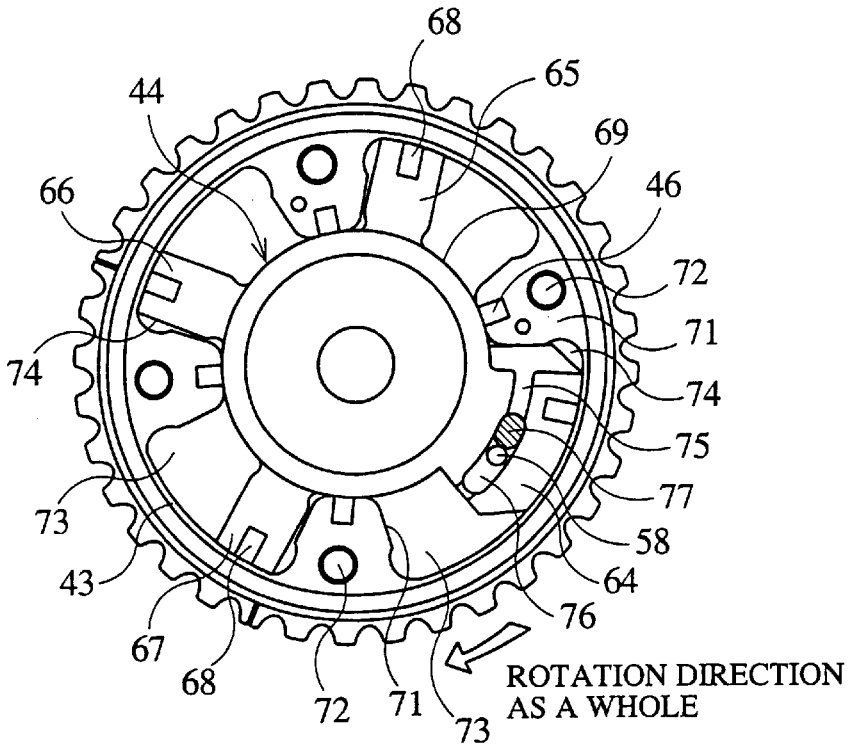
FIG.26 (PRIOR ART)
FIG. 26 is a cross sectional view of FIG. 23 along the line X—X.
Figure 27:
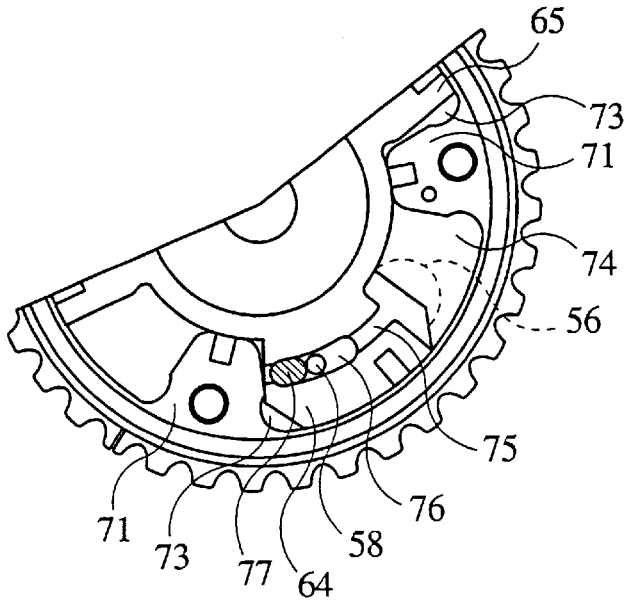
FIG.27 (PRIOR ART)
FIG. 27 is a cross sectional view in part, showing a state that a slide plate in FIG. 26 is displaced.
Figure 28:
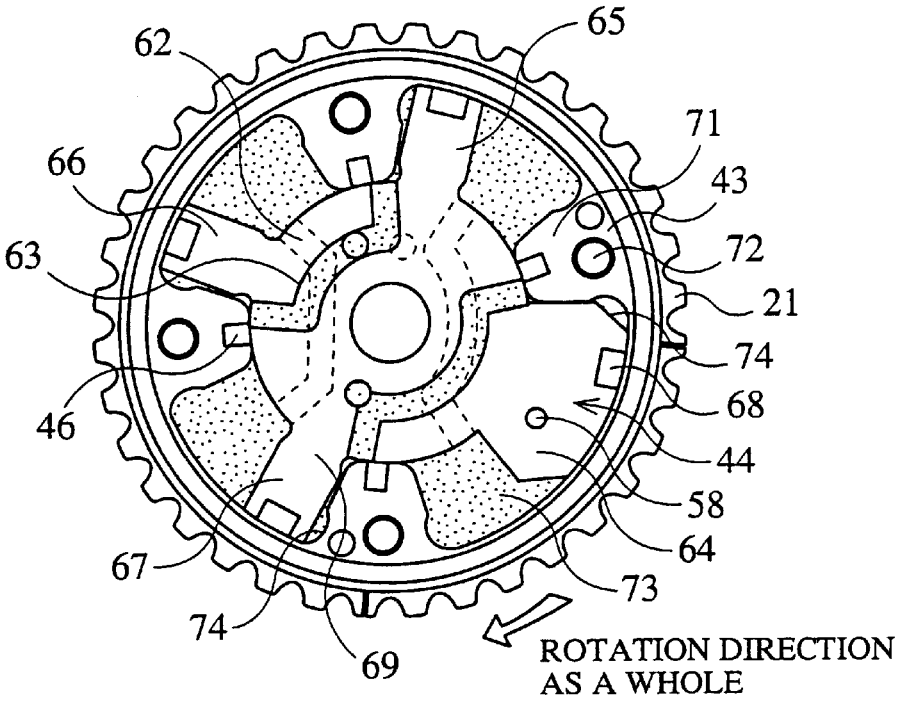
FIG.28 (PRIOR ART)
FIG. 28 is a cross sectional view of FIG. 23 along the line Y—Y.
Figure 29:
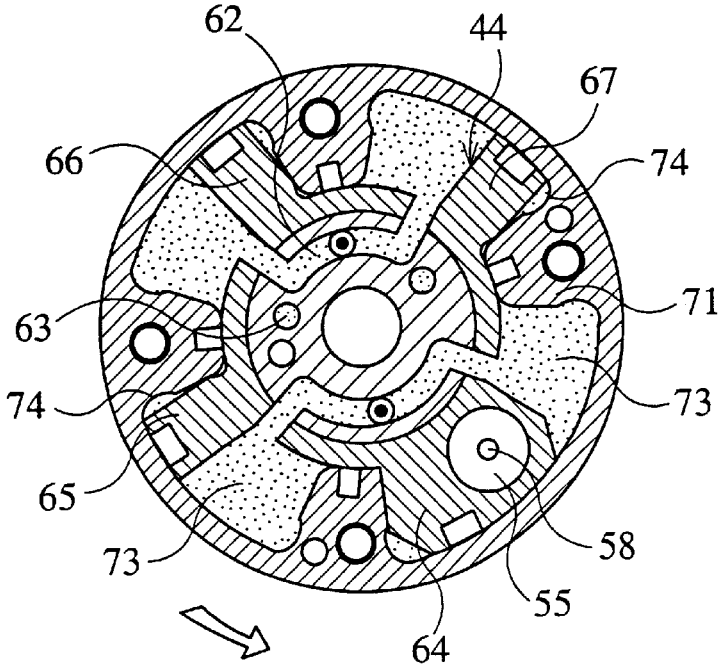
FIG.29 (PRIOR ART)
FIG. 29 is a cross sectional view of FIG. 23 along the line Z—Z.

The embodiment 3 was explained, supposing that the chip seal 1 has a shape shown in FIG. 18, however the shape of the chip seal 1 is not limited to this form. For example, the chip seal 1 may have a hollow portion 1*c* at its bottom as well as a concave recessing portion 1*d* at its side surface, as shown in FIG. 22. Also, such a chip seal has effects similar to that of ship seal shown in FIG. 18. The working oil can flow easily into the hollow portion 1*c* through the concave recessing portion 1*d*, thus a stable sealing force can be promptly obtained and assured. The material cost for the chip seal can be reduced, without reducing the tolerable strength. However, it shall be noted that the hollow portion 1*c* is not inevitable. For example, the chip seal can have a shape as shown in FIG. 5(*b*).

An advantage of the present invention is that the sealing element can be pressed to the counter surface by the oil pressure, without using a supplemental pressing means, for example, a spring in the prior art. Therefore the number of fabrication elements and the steps for assembling them can be reduced. As a result, the productivity can be improved, and the production cost can be reduced.

In case that the edge of the seal groove is chamfered to be round or flat, the working oil can easily enter into the gap between the sealing element and the seal groove, thus, a sealing force can be promptly assured.

In case that the flanks of the seal groove are tapered so that the width of the groove is larger at the outer portion of the groove, the working oil can easily enter into the gap between the tilted sealing element and the tapered seal groove, thus, a sealing force can be promptly assured.

In case that the sealing element has a form of box having a hollow portion at its bottom, the acting plane of the force to displace the chip seal becomes nearer to the inner surface of the case 43. As a result, a stable sealing force can be assured.

In case that the rotor further comprises a locking means for suppressing the rotation of the rotor relative to the housing, an unlocking means for releasing the suppression of rotation by the locking means, and an oil channel connecting between the bottom of the seal groove and the unlocking means, and the oil channel serves to supply a working oil into the unlocking means, it is possible to deliver a working oil to the locking means to release the suppression of the rotation, by shifting the sealing element, and without using a complex oil pressure delivering mechanism, for example, a slide plate in the prior art. As a result, the number of fabrication elements can be reduced.

What is claimed is:

1. A vane type hydraulic actuator comprising:

a housing rotatably fixed on a rotation shaft;

a case having an inner space therein, the case is fixed to the housing;

a rotor fixed to the shaft and received in the inner space of the case, the rotor having a plurality of vanes for forming oil pressure chambers, the rotor controlling the angle of the rotation shaft relative to the housing on the basis of oil pressures delivered in the oil pressure chambers;

sealing elements disposed at corresponding contacting portions between the rotor and the case, each of the sealing elements received in a corresponding seal groove, the edge of the seal groove chamfered to be round or flat, the sealing elements disposed on the rotor as well as on the case;

wherein for each sealing element and corresponding seal groove, a hydrodynamic resistance of the working oil at a seal gap between a tip of the sealing element, which is received in the seal groove, and a counter surface, where the tip of the sealing element contacts tightly, is larger than that at a gap between a flank of the sealing element and a counter flank of the seal groove.

2. A vane type hydraulic actuator according to claim 1, wherein, for each sealing element, a seal distance D between the tip of the sealing element and the counter surface is smaller than a distance F of the gap between the flank of the sealing element and the counter flank of the seal groove, and the seal distance D between the tip of the sealing element and the counter surface is smaller than a distance of the gap E between the rotor and the case.

3. A vane type hydraulic actuator according to claim 1, wherein each sealing element is a seal chip.

4. A vane type hydraulic actuator according to claim 1, wherein the flanks of the seal groove are tapered so that the width of the groove is larger at the outer portion of the groove.

5. A vane type hydraulic actuator according to claim 4, wherein for each sealing element and corresponding seal groove a seal distance D between the tip of the sealing element and the counter surface is smaller than a product of a height A of the sealing element and tan θ, where θ is a tapering angle of the counter flank of the seal groove, and the seal distance D between the tip of the sealing element and the counter surface is smaller than a distance of the gap E between the rotor and the case.

6. A vane type hydraulic actuator according to claim 4, wherein for each sealing element and corresponding seal groove a height A of the sealing element is smaller than a distance C between the bottom of the seal groove and the counter surface of the sealing element, and the distance C between the bottom of the seal groove and the counter surface of the sealing element is smaller than a distance G between an outer edge of the sealing element and its diagonal inner corner, and a seal distance D between the tip of the sealing element and the counter surface is smaller than a distance of the gap E between the rotor and the case.

7. A vane type hydraulic actuator according to claim 1, wherein each sealing element has a form of a box having a hollow portion at its bottom.

8. A vane type hydraulic actuator according to claim 1, wherein when an oil pressure is imposed to at least one of the sealing elements, at first, the at least one of the sealing elements moves in a peripheral direction to contact with a wall of the groove, then the at least one of the sealing elements moves in a radial direction to contact with the counter surface.

9. A vane type hydraulic actuator according to claim 1, wherein the seal groove is chamfered to be round.

10. A vane type hydraulic actuator according to claim 1, wherein the seal groove is chamfered to be flat.

11. A vane type hydraulic actuator the comprising;

a housing rotatably fixed on a rotation shaft;

a case having an inner space therein, the case is fixed to the housing;

a rotor fixed to the shaft and received in the inner space of the case, the rotor having a plurality of vanes for forming oil pressure chambers, the rotor controlling the angle of the rotation shaft relative to the housing on the basis of oil pressures delivered in the oil pressure chambers;

sealing elements disposed at corresponding contacting portions between the rotor and the case, each of the sealing elements received in a corresponding seal groove, the sealing elements disposed on the rotor as well as on the case;

a locking means for suppressing the rotation of the rotor relative to the housing;

an unlocking means for releasing the suppression of rotation by locking means; and an oil channel connecting between the bottom of at least one seal groove and the unlocking means, the oil channel supplying a working oil into the unlocking means so as to release the suppression of rotation by the locking means;

wherein for each sealing element and corresponding seal groove, a hydrodynamic resistance of the working oil at a seal gap between a tip of the sealing element, which is received in the seal groove, and a counter surface, where the tip of the sealing element contacts tightly, is larger than that at a gap between a flank of the sealing element and a counter flank of the seal groove.

12. A vane type hydraulic actuator according to claim 11, wherein said oil channel is formed as a groove disposed at an end face of the rotor in a longitudinal direction.

13. A vane type hydraulic actuator comprising:

a housing rotatably fixed on a rotation shaft;

a case having an inner space therein, the case is fixed to the housing;

a rotor fixed to the shaft and received in the inner space of the case, the rotor having a plurality of vanes for forming oil pressure chambers, the rotor controlling the angle of the rotation shaft relative to the housing on the basis of oil pressures delivered in the oil pressure chambers;

sealing elements disposed at corresponding contacting portions between the rotor and the case, each of the sealing elements received in a corresponding seal groove, the sealing elements disposed on the rotor as well as on the case;

wherein for each sealing element and corresponding seal groove, a hydrodynamic resistance of the working oil at a seal gap between a tip of the sealing element, which is received in the seal groove, and a counter surface, where the tip of the sealing element contacts tightly, is larger than that at a gap between a flank of the sealing element and an counter flank of the receiving groove, and wherein each sealing element has a form of a box having a hollow portion at its bottom intermediate to two leg portions disposed near or at opposite ends of the sealing element, wherein the sealing element is supported at a bottom of the seal groove by the two leg portions, and wherein the hollow portion forms a straight unobstructed passage from one flank of the sealing groove to an opposing flank of the sealing groove when viewed in an axially direction of the rotor.

14. A vane type hydraulic actuator comprising:

a housing rotatably fixed on a rotation shaft;

a case having an inner space therein, the case is fixed to the housing;

a rotor fixed to the shaft and received in the inner space of the case, the rotor having a plurality of vanes for forming oil pressure chambers, the rotor controlling the angle of the rotation shaft relative to the housing on the basis of oil pressures delivered in the oil pressure chambers;

sealing elements disposed at corresponding contacting portions between the rotor and the case, each of the sealing elements received in a corresponding seal groove, the sealing elements disposed on the rotor as well as on the case;

wherein for each sealing element and corresponding seal groove, a hydrodynamic resistance of the working oil at a seal gap between a tip of the sealing element, which is received in the seal groove, and a counter surface, where the tip of the sealing element contacts tightly, is larger than that at a gap between a flank of the sealing element and a counter flank of the seal groove; and wherein the rotor further comprises:

a locking means for suppressing the rotation of the rotor relative to the housing;

an unlocking means for releasing the suppression of rotation by locking means; and an oil channel connecting between the bottom of at least one seal groove and the unlocking means, the oil channel supplying a working oil into the unlocking means so as to release the suppression of rotation by the locking means; and wherein said oil channel is formed as a groove disposed at an end face of the rotor in a longitudinal direction.

* * * * *